US005993601A

United States Patent [19]

Wennberg et al.

[11] Patent Number: 5,993,601

[45] Date of Patent: Nov. 30, 1999

[54] PROCESS FOR PRODUCING POLYSULPHIDE BY MEANS OF OXIDIZING SULPHIDE IN SPENT LIQUORS FROM KRAFT CELLULOSE COOKING

[75] Inventors: Olle Wennberg; Martin Wimby, both of Gothenburg, Sweden

[73] Assignee: Kvaerner Pulping AB, Karlstad, Sweden

[21] Appl. No.: 09/010,504

[22] Filed: Jan. 21, 1998

Related U.S. Application Data

[63] Continuation of application No. PCT/SE96/00832, Jun. 24, 1996.

[30] Foreign Application Priority Data

Jul. 4, 1995 [SE] Sweden ..... 9502419

[51] Int. Cl.[6] ..... D21C 11/12

[52] U.S. Cl. ..... 162/30.1; 162/30.1; 162/30.11; 162/38; 162/82; 423/562

[58] Field of Search ..... 162/30.11, 38, 162/82, 29, 30.1; 423/562, DIG. 3

[56] References Cited

U.S. PATENT DOCUMENTS

| | | | |
|---|---|---|---|
| 5,082,526 | 1/1992 | Dorris | 162/30.11 |

FOREIGN PATENT DOCUMENTS

| | | |
|---|---|---|
| 0649939 | 4/1995 | European Pat. Off. . |
| 8106203 | 4/1983 | Sweden . |
| 1112-081 | 5/1983 | U.S.S.R. . |
| WO 94/09204 | 4/1994 | WIPO . |

*Primary Examiner*—Dean T. Nguyen
*Attorney, Agent, or Firm*—Jeffrey S. Melcher; Farkas & Manelli, PLLC

[57] ABSTRACT

The invention relates to a process for producing polysulphide by means of oxidizing sulphide in spent liquors from kraft cellulose cooking. The process is characterized in that green liquor is firstly enriched in sulphide and then oxidized.

18 Claims, No Drawings

PROCESS FOR PRODUCING POLYSULPHIDE BY MEANS OF OXIDIZING SULPHIDE IN SPENT LIQUORS FROM KRAFT CELLULOSE COOKING

This is a continuation of International application No. PCT/SE96/00832 filed Jun. 24, 1996 which designated the U.S. This application also claims priority to Swedish patent application No. 9502419-6 filed Jul. 4, 1995.

BACKGROUND OF THE INVENTION

The present invention relates to a process for producing polysulphide by means of oxidizing sulphide in spent liquors from kraft cellulose cooking. This treatment of spent liquors from the kraft cellulose cooking is designed to raise the quality of the liquor which is once again introduced into the cellulose digester.

STATE OF THE ART

When cellulose is produced by cooking in accordance with the kraft cellulose method, a spent liquor is obtained, after the cellulose has been separated off after the cooking, which is termed black liquor and which constitutes an aqueous solution of dissolved lignin, various other dissolved organic constituents, sodium sulphide, sodium sulphate, sodium thiosulphate, sodium carbonate, sodium hydroxide and, to a lesser degree, calcium carbonate, together with salts or hydroxides of manganese, magnesium, iron, aluminium and similar metals which have been dissolved out of the wood. The black liquor is evaporated, by means of various processes, to such an extent that the concentrated black liquor can be combusted. This combustion usually takes place in so-called recovery boilers and the purpose of the combustion is to extract energy, by means of combustion, from the organic substances and to recover the inorganic substances, which, in smelted form, are removed from the lower part of the recovery boiler.

The smelted chemicals from the recovery boiler are then dissolved in water, with a so-called green liquor being obtained. This principally consists of sodium carbonate (from 50 to 60%) and sodium sulphide. However, the sodium sulphide decomposes into sodium hydrogen sulphide and sodium hydroxide.

The green liquor is then causticized by means of adding calcium oxide, whereupon calcium carbonate, termed lime sludge, and sodium carbonate precipitate out. This resulting liquor is termed white liquor and is reused in the cooking of fresh kraft cellulose pulp.

A series of different chemical reactions take place in association with the dissolution of the lignin and the defibring of the cellulose during the cooking. These reactions are more or less known. An undesirable chemical reaction is that the cellulose itself can be broken down. In order to suppress such a breakdown to the greatest possible extent, it has been concluded that the liquor which is added in the first part of the cooking should contain polysulphides. These latter prevent the breakdown of the cellulose and consequently increase the yield of the pulp. However, the breakdown can be desirable in the case of a pulp of poor quality which contains a relatively large proportion of hemicellulose, since it is the hemicellulose which is broken down first and the quality of the cellulose which is obtained in the final stage is therefore increased.

Elemental sulphur may also be added in the first part of the cooking instead of the polysulphides. This measure has the intended effect; however, since sulphur is being added to the process, it must also be removed subsequently, thereby giving rise to problems, especially of an environmental nature. The addition of elemental sulphur is therefore a makeshift solution which is best avoided.

The polysulphide which is added in the first part of the cooking is therefore almost exclusively produced by oxidizing the sodium sulphide present in the spent liquor to sodium polysulphide to a greater or lesser degree. Various processes have been developed for bringing about this oxidation. One process is described, for example, in U.S. Pat. No. 5,082,526. This process is based on using air or oxygen to oxidize a liquor which consists of white liquor in which lime sludge particles, that is calcium carbonate, are present. The lime sludge is derived from the causticization of green liquor and particles of the lime sludge are allowed to remain during the oxidation. A partially causticized green liquor can be oxidized in this manner. The reason for allowing at least a portion of the lime sludge to remain is that this sludge constitutes a catalyst for the conversion of sodium sulphide to sodium polysulphide.

Another method for producing polysulphide from white liquor by means of oxidation is described in U.S. Pat. No. 4,024,229. In this case, the oxidation of white liquor by air or oxygen is achieved in the presence of a catalyst consisting of activated carbon. Neither in this method nor in other methods does the oxidation of sodium sulphide give rise solely to sodium polysulphide; it also gives rise to a certain quantity of sodium thiosulphate. This latter compound is not desirable and is present in the form of solid particles.

TECHNICAL PROBLEM

While many processes may be used, per se, for oxidizing sodium sulphide to sodium polysulphide, they result in a low yield, on the one hand, and, on the other, are complicated by the fact that they require the liquor to be of high purity in order to ensure that the catalyst is not poisoned. This is particularly the case with a carbon catalyst, which requires the liquor to be of high purity and the catalyst to be changed frequently.

SUMMARY OF THE INVENTION

There has, therefore, long been a need to improve the known processes in order to obtain a higher yield of sodium polysulphide without using a sensitive catalyst, and a process has therefore been developed, in accordance with the present invention, for producing polysulphide by means of oxidizing sulphide in spent liquors from kraft cellulose cooking, which process is characterized in that green liquor is firstly enriched in sulphide and is then oxidized.

It is expedient for the green liquor to be partially causticized prior to the enrichment in sulphides.

According to the invention, calcium particles (lime sludge) may be present in the liquor both in association with the enrichment with sulphide and during the oxidation.

When the green liquor is causticized, it can, according to the invention, be causticized up to as much as 50% of the normal degree of causticization.

According to the invention, green liquor sludge can be added prior to or during the oxidation.

Black liquor can also be added to the green liquor prior to the oxidation.

According to the invention, the green liquor to which black liquor has been added and which has been oxidized to a high polysulphide content may expediently be used for impregnating wood chips which are to be cooked.

The enrichment with sulphides can be achieved, for example, by sodium carbonate being crystallized out and filtered off from the green liquor. The green liquor, which can be partially causticized and contain lime sludge, is evaporated, in association with which sodium carbonate precipitates out and can be filtered off together with the lime sludge. In this way, a sulphide-rich liquor is obtained which can be further causticized to form white liquor. Such an enrichment of the green liquor with sulphide is described in Swedish Patent no. 500748. The green liquor is expediently causticized by this procedure up to 50% of the normal degree of causticization before the sulphide is oxidized to polysulphide in accordance with the present invention.

When the smelted chemicals from the recovery boiler are dissolved to form green liquor, a so-called green liquor sludge is obtained. This consists of solid constituents, principally calcium carbonate and magnesium hydroxide, but also manganese hydroxide, iron salts, aluminium salts and the like, in addition to carbon particles and possibly other ash substances as well. According to the invention, this green liquor sludge, which contains manganese ions, inter alia, can be added prior to or during the oxidation of sulphide to polysulphide. In this way, a higher yield is obtained by virtue of the catalytic effect of the green liquor sludge, principally due to the manganese content of the sludge.

The sulphide-enriched green liquor can also be treated with black liquor prior to the oxidation and then be oxidized. All the constituents of the green liquor sludge are present in the black liquor and these constituents will then exert a catalytic effect during the oxidation of the sulphide-enriched green liquor.

This oxidized mixture of green liquor and black liquor is especially suitable for impregnating wood chips which are to be cooked in accordance with the kraft method.

The invention is not limited to the abovementioned embodiments and can be varied in different ways within the scope of the patent claims.

We claim:

1. Process for producing polysulphide liquor comprising the steps of:

enriching a sulphide content in a green liquor to form a sulphide enriched green liquor; and oxidizing said sulphide enriched green liquor to form a polysulphide liquor.

2. Process according to claim 1, further comprising the step of partially causticizing the green liquor before said step of enriching said sulphide content in said green liquor to form a partially causticized green liquor.

3. Process according to claim 2, wherein said causticizing step comprises causticizing the green liquor up to 50% of a normal degree of causticization.

4. Process according to claim 2, wherein said step of enriching said sulphide content of said green liquor comprises evaporating said partially causticized green liquor and separating crystallized sodium carbonate from said green liquor.

5. Process according to claim 1, further comprising the step of adding calcium particles to said green liquor prior to said step of enriching said sulphide content in said green liquor.

6. Process according to claim 5, wherein said step of adding calcium particles comprises adding lime sludge to said green liquor.

7. Process according to claim 1, further comprising the step of adding green liquor sludge to said green liquor prior to or during said oxidation step.

8. Process according to claim 1, further comprising the step of adding black liquor to said green liquor prior to said oxidation step.

9. Process according to claim 1, wherein said step of enriching said sulphide content of said green liquor comprises separating sodium carbonate from said green liquor.

10. Process for producing polysulphide liquor comprising the steps of:

partially causticizing a green liquor to form a partially causticized green liquor;

enriching a sulphide content in said partially causticized green liquor to form a sulphide enriched green liquor;

adding at least one of green liquor sludge or black liquor to said sulphide enriched green liquor; and oxidizing said sulphide enriched green liquor to form a polysulphide liquor.

11. Process of preimpregnating wood chips with a polysulphide liquor to enhance the polysulphide concentration in said wood chips, said process comprising the steps of:

enriching a sulphide content in a green liquor to form a sulphide enriched green liquor;

oxidizing said sulphide enriched green liquor to form a polysulphide liquor; and impregnating wood chips with said polysulphide liquor to enhance the polysulphide concentration of said wood chips.

12. Process according to claim 11, further comprising the step of partially causticizing said green liquor prior to said step of enriching a sulphide content of said green liquor to form a partially causticized green liquor.

13. Process according to claim 12, wherein said green liquor is partially causticized up to 50% of a normal degree of causticization.

14. Process according to claim 11, further comprising the step of adding at least one of green liquor sludge or black liquor to said green liquor prior to or during said oxidizing step.

15. Process according to claim 11, further comprising the step of adding calcium particles to said green liquor prior to said step of enriching said sulphide content in said green liquor.

16. Process according to claim 15, wherein said step of adding calcium particles comprises adding lime sludge to said green liquor.

17. Process according to claim 11, wherein said step of enriching said sulphide content of said green liquor comprises separating sodium carbonate from said green liquor.

18. Process according to claim 11, wherein said step of enriching said sulphide content of said green liquor comprises evaporating said partially causticized green liquor and separating crystallized sodium carbonate from said green liquor.

* * * * *